United States Patent [19]

Talarico, II

[11] Patent Number: 4,620,376

[45] Date of Patent: Nov. 4, 1986

[54] FOREFOOT VALGUS COMPENSATED FOOTWEAR

[76] Inventor: Louis C. Talarico, II, 116 Wood St., P.O. Box 180, Lewistown, Me. 04240-0180

[21] Appl. No.: 693,558

[22] Filed: Jan. 22, 1985

[51] Int. Cl.[4] ..... A43B 5/00; A43B 13/38

[52] U.S. Cl. ..... 36/103; 36/127; 36/114; 36/25 R; 36/30 R; 128/584

[58] Field of Search ..... 36/103, 25, 88, 43, 36/114, 93, 127, 113; 128/584, 585

[56] References Cited

U.S. PATENT DOCUMENTS

| | | | |
|---|---|---|---|
| 1,039,396 | 9/1912 | Hilgert | 36/43 |
| 1,137,092 | 4/1915 | Sharp | 36/43 |
| 1,958,097 | 5/1934 | Shaw | 128/585 |
| 2,008,207 | 7/1935 | Greenberg | 36/43 |
| 2,052,115 | 8/1936 | Shulman | 36/25 R |
| 2,216,630 | 10/1940 | Sabel et al. | 128/584 |
| 2,616,190 | 11/1952 | Darby | 128/583 |
| 2,847,769 | 8/1958 | Schlesinger | 36/127 |
| 4,180,924 | 1/1980 | Subotnick | 36/127 |
| 4,240,214 | 12/1980 | Sigle et al. | 36/43 |

FOREIGN PATENT DOCUMENTS

| | | | |
|---|---|---|---|
| 981902 | 1/1976 | Canada | 128/584 |
| 1029264 | 4/1958 | Fed. Rep. of Germany | 36/43 |
| 1141593 | 9/1957 | France | 36/127 |

*Primary Examiner*—Werner H. Schroeder
*Assistant Examiner*—Steven N. Meyers
*Attorney, Agent, or Firm*—Caesar, Rivise, Bernstein & Cohen, Ltd.

[57] ABSTRACT

In an article of footwear for use with a foot wherein the article has an upper portion and a sole. The sole has a forefoot and a rearfoot portion with the sole forefoot portion having a medial aspect and a lateral aspect. The sole forefoot portion is of varying thickness across the width thereof such that the sole slopes at an angle upwardly from the medial aspect to the lateral aspect to provide an inclined surface of greater thickness at the lateral aspect than at said medial aspect. This compensates the forefoot in its naturally everted angulation in those individuals who are recognized to have a forefoot valgus foot type and maintains the normal alignment, position, motion and function of the entire foot during use of said article of footwear.

8 Claims, 14 Drawing Figures

FOREFOOT VALGUS COMPENSATED FOOTWEAR

BACKGROUND OF THE INVENTION

The present invention relates to new footwear compensating the human foot to its environment.

While the prevailing human foot is usually angulated somewhat upward from the horizontal from its lateral side, there exists in a smaller percentage of the general population, a clinical entity whereby the forefoot section of the foot is everted, or rotated so that the plantar surface of the forefoot faces slightly away from the midline of the body and away from a transverse plane. In this regard, although the rearfoot and lower leg are still in their usual and slightly varus attitude, generally bent inward; the forefoot section of the foot is rotated and angulated in an opposite, valgus, direction relative to the rearfoot, the leg, and relative to a horizontal, transverse plane.

The median sagittal plane is the midline of the body, which divides the body into equal right and left halves and touches the floor at a position midway between two parallel feet when the body is in an erect anatomical position. The foot also has a median sagittal plane which divides each foot into equal medial and lateral (left and right) halves or aspects. A sagittal plane itself is a flat plane passing through the body while in an erect anatomical position. This plane passes through the body in an anterior-posterior direction and divides the body into right and left parts, where the body is erect and the feet are parallel. A transverse plane is a flat, horizontal plane that lies parallel to the horizon and passes through the body in an erect anatomical position and which divides the body into superior (upper) and inferior (lower) parts.

The normal longitudinal axis of motion of the foot is a line that represents the ideal physical relationship of the osseous segments of the foot as they relate to foot function. The normal longitudinal axis of motion also indicates the preferred direction of vector forces generated through the foot for the production of maximum and optimum efficiency of foot function during static stance and locomotion. The longitudinal axis of motion and the median sagittal plane of the foot should normally and ideally be in close proximity. The more closely that these two clinical entities are correlated and aligned; the more closely one achieves the ideal biophysical criteria for normal position, motion and function of the foot.

Most feet and lower legs usually have an inverted angulation which is residual from their fetal growth, and similar to their position in the classical in utero fetal position. In this regard, the heel, (rearfoot), is almost always slightly inverted to the transverse (horizontal) plane, approximately 4 degrees plus or minus amounts up to 2 degrees, on the average. This is commonly referred to as rearfoot or subtalar joint varus.

Occasionally, both the rearfoot and forefoot sections of the foot will be deviated from their usual, customary, and generally inverted alignment. Only very rarely is the heel (rearfoot) alignment found to be perfectly perpendicular or square to the transverse (horizontal) plane. In these occasional instances, the heel (rearfoot) would be considered ideally suited to adapt to/and function on modern society's flat surfaces. On other extremely rare occasions, the heel (rearfoot) is everted or tilted and rolled outward while off weight-bearing so that the plantar surface of the heel faces away from the midline of the body and away from the transverse (horizontal) plane in its natural, relaxed and dangling, position. This clinical entity is referred to as rearfoot or subtalar joint valgus and is only observed in individuals who exhibit true and frank foot deformity as differentiated from the more common deviations of foot type.

The lower legs are also usually slightly inverted to the ground by approximately 4 degrees plus or minus amounts up to 2 degrees, on the average and this is commonly referred to as tibial varum. Only occasionally are the legs anatomically straight and in perfect alignment perpendicular to flat surfaces. In these rare and occasional instances, the legs are considered to be ideally suited for adaptation and functioning on modern society's usually flat surfaces.

On yet other occasions, the legs are bent backwards, "bowed", or "knocked" at the knees. These variations of the legs at the knees are commonly referred to as genu recurvatum, genu varum, and genu valgum, respectively.

The forefoot section of the foot in the largest majority of the general population is almost always inverted additionally to the rearfoot alignment by an added amount of approximately 8 degrees plus or minus amounts up to 6 degrees, on the average. This is commonly referred to as forefoot or midtarsal joint varus. Only occasionally is the plantar aspect of the forefoot alignment found to be parallel and level to the transverse (horizontal) plane. In these occasional instances, the forefoot is considered to be ideally suited to adapt to/and function on modern society's flat surfaces. On other occasions, the forefoot is everted relative to the rearfoot and relative to the transverse (horizontal) plane. This forefoot deviation is commonly referred to as forefoot or midtarsal joint valgus. Although this clinical entity is only recognized in approximately 5 percent of the population as a whole; it is the purpose and intention of this specification and the present invention to provide a forefoot compensation for footwear that will provide an accommodation for this limited variation of a foot type.

On other extremely rare occasions, the extent and degree of malalignment in the relative relationships of the forefoot to the rearfoot, the rearfoot to the leg, and the leg to the ground are of such severity and magnitude that they constitute quite serious and frank deformity of the foot (feet) or leg(s). It is not the purpose or intention of this invention to attempt to address these or other frank deformities of the feet or lower extremities. It is the express purpose and intent of the present invention to provide forefoot compensation for the more common, less obvious, forefoot valgus variation of foot type by intervening in situations where otherwise, normal, healthy feet (including those with minor deviations in conformation and shape) are required to compensate in order to come in full and complete contact with modern society's flat surfaces when standing or completing a step in the act of human locomotion.

In the past, the science of biomechanics and prior art footwear used society's horizontal, flat, and level surfaces as the basis for "normalcy" to which all feet were compared and to which feet were required to conform. As a result of this thinking, any deviation of foot type from that of society's usual flat surface constituted "abnormality". Consequently, only those occasional, perfectly straight, perpendicular, square and level feet and legs that would be considered ideally suited to adapt to flat surfaces were considered to be "normal". When, in fact, the human foot is still in a period of evolutionary transition toward more efficient, upright, bipedal locomotion and at our present state of developmental anatomy, most individual's still-contoured feet are placed at a functional disadvantage and are not ideally suited for use on modern flat, hard, and unyielding surfaces. In this regard, man's technological environment and usually flat surfaces have evolved more rapidly than the architecture of his foot, so that modern society's flat surfaces have become a common pathological denominator to which most feet have been required to conform, compensate, and adapt themselves to. In order for most individual's to apply their forefoot to flat, hard, walking or running surfaces; they must compromise the natural attitude, position, motion, and function of the feet. This in turn inflicts the feet, ankles, knees, legs, hips, and back and results in the multitude of symptoms that are commonly seen in medical practice. Surveys and statistics show evidence that these afflictions affect approximately three-fourths of today's population.

Although most weight-bearing feet tend to pronate abnormally and excessively on a flat surface in order to compensate for their inherent inverted (varus) angulation; there are those occasional foot types that are characterized and classified according to their forefoot valgus component. These feet are required to supinate abnormally and excessively when they come in full and complete contact with flat surfaces.

Excessive supination is considered to be the unnatural position, motion, and function that the foot assumes when the foot is required to go through an excessive amount and range of motion in order to compensate for inherent anatomical variations or other planal predominances of the foot from flat surfaces. The weight-bearing vector forces of excessive supination are generated more laterally and away from the longitudinal axis of motion and the midline of the foot and are directed more toward the outside of the body.

Supination is a complex simultaneous triplane motion generally in the direction of adduction, inversion and plantarflexion. The axis of this motion passes through the foot from the posterior, lateral and plantar portions of the foot to the anterior, medial and dorsal portions of the foot.

The motion of normal supination generally passes along the longitudinal axis of motion of the foot. A smooth, more ideal, movement of the foot, with a minimum of supination and pronation occurs when weight-bearing forces directed through the foot pass closer to the longitudinal axis of motion and the median sagittal plane of the foot as the foot moves through the various stages of its gait.

A small amount of rearfoot and forefoot pronation and supination themselves are considered to be normal and are necessary for the foot to act as an effective shock absorber and as a rigid propulsive lever during the act of locomotion. Beyond those accepted amounts, rearfoot and forefoot supination and pronation are considered to be abnormal, excessive, and not within an acceptable range of motion.

Since nearly all individuals within the general population possess different degrees of variation of foot type and amounts of abnormal pronation and supination, ranging from slightly excessive to extremely excessive; it is the purpose and intention of the present invention to compensate for as much of these varying amounts of supination that are in excess of the normal amount of allowable foot motion by prohibiting those additional amounts to occur. Excessive amounts of supination usually fall within the range of from 2 degrees to 14 degrees of additional motion; that is, motion which is in excess of the allowable amount of normal motion (normal supination).

Excessive supination of the weight-bearing foot on a flat surface comes about when, occasionally, some feet, which have a forefoot valgus component off weight-bearing, attempt to meet and align themselves with the ground (flat surfaces). In order to accomplish proper support, balance, equilibrium and ultimately propulsion, the rearfoot is required to follow the motion and action of the everted, (valgus), forefoot when the forefoot meets the ground and thus the entire foot (including the rearfoot) is forced to supinate excessively. More specifically, the rearfoot goes through an excessive range of motion to allow this function and motion of the forefoot to occur due to the fact that rearfoot stability (or instability) is dependent upon the structure and stability (or instability) of the forefoot.

Ideally, the weight-bearing foot should be in its natural planal predominent off weight-bearing position at the time when it makes full contact with the surface upon which the foot bears and when it is fully weight-bearing; rather than compensating to meet the flat surface.

The present invention is for footwear which allows the forefoot to function in its everted attitude and position with the footwear adapted to the environmentally flat surface while the foot is able to comfortably be positioned in its natural position.

Podiatric literature deals with the foot in terms of the foot having abnormality in supinating excessively. In the past, some recognition has been given to the angulation of feet, and particularly with regard to running shoes. The prior art concerned itself only with changing the angular relationship between the heel and a flat surface. Subotnick in his U.S. Pat. No. 4,180,924 attempted to improve footwear by providing a running shoe with a wedge at the heel portion of the footwear. The wedge tended to compensate the heel to react to a flat surface in its attempt to avoid some excessive pronation. The emphasis seems to have been placed on compensating the heel since the heel in walking or running usually makes the first contact with the ground and is the area where excessive pronation or supination is most obviously noticed in most individuals.

Block in his U.S. Pat. No. 4,262,435 also discloses a compensated heel. Both Subotnick and Block substantially ignore compensating footwear at the forefoot and its relationship to excessive pronation or supination.

It should be noted that Subotnick provides a transverse beveled sole tapering from the heel, past the arch, to its ending point, located immediately to the rear of the metatarsal-phalangeal joints (the ball of the foot). By the same token, Block's sole piece also has a relatively thickened body extending from the heel counter, forwardly and downwardly, and ending its taper also behind the metatarsal-phalangeal joints (the ball of the foot).

Footwear compensations of the past have attempted to correct the inverted heel, or otherwise have attempted to stabilize the rearfoot and thereby hoped to restrict or eliminate excessive pronation of the rearfoot. It should be noted that in the prior art, compensation of the heel, while providing a substantially horizontal impact of the heel to a flat surface, does not compensate the inverted or everted position of the forefoot, which, according to the prior art, still was subject to excessive pronation or supination. Most rearfoot compensations of prior art shoes, in fact, tend to restrict the rearfoot's own natural inverted planal predominance that would otherwise allow the rearfoot to pronate normal amounts in order to act as an effective shock absorber when coming in contact with the ground.

No attempts have been made in prior art footwear to restrict or eliminate excessive supination of the rearfoot. All prior art compensations also ignore the everted forefoot which actually, and in fact, causes the resultant outward rolling and tipping of the subtalar and ankle joints (excessive rearfoot supination) in a small percentage of the population; as the rearfoot rolls laterally and inverts following the movement of the everted forefoot away from the ground.

Tager in his U.S. Pat. No. 4,333,472 does attempt to address both of these concerns; however, from the prior art perspective of "abnormality" and by the use of small compensatory-corrective cushion pads to be applied to the inside of footwear or intended to be applied to the foot. These small, differentially sized, geometrically shaped, and specifically configured cushion pads are designed and intended to be held between the subject's foot and the footwear. They also are intended to have an adhesive coating and backing protected by a peel-off cover so that they might be placed or attached in the subject's footwear. These small cushion pad inserts do not constitute any alteration in actual shoe design and construction; and therefore, would have no application to new footwear or to the shoe construction and shoe manufacturing industries. Additionally, Tager's cushion pads are of such small overall dimension that they could not effectively be considered midsole, innersole, or outersole unit components commonly used in the footwear industries; such as is the intended use of the preferred embodiment of the present invention.

According to the present invention new footwear is provided compensating the forefoot's angulation by providing an angulated sole sloping upward from the medial aspect of the forefoot to the lateral aspect, compensating the forefoot along the base and shafts of the metatarsal bones diagonally, the metatarsal-phalangeal joints (the ball of the foot), and the toes, giving the area beneath the fifth metatarsal-phalangeal joint (the little toe joint) the greatest elevation.

It has been found that the angulated wedge-shaped sole of the footwear of the present invention aligns the foot by compensating to angulate the forefoot to the heel and as a result, the entire foot to the ground for proper weight-bearing and even weight distribution. That is, the angulated wedge-shaped sole in the present invention compensates the forefoot and by so doing, whether the foot is standing still or in normal walking or running gait, weight-bearing forces directed through the foot pass closer to the median sagittal plane and the normal longitudinal axis of motion of the foot from rearfoot to forefoot. The footwear of the present invention compensates the valgus forefoot to modern civilization's usually flat surfaces.

The advantages of the footwear of the present invention are that whether for normal standing, walking or for running, the footwear is adapted to the flat surface while the foot is maintained in its natural position. In standing, walking or running, excessive supination is reduced, controlled or eliminated; the foot acts as a more immediate and effective fulcrum and lever for the walking or running step with the minimum waste of movement and distortion of the natural foot; and impact shock to the foot and the entire skeletal complex is minimized as the foot functions more efficiently and as a more effective shock absorber. The forward movement of the foot from the strike of the heel in its normal gait in walking or running proceeds to a flat contact of the footwear of the present invention with a flat surface during its fully weight-bearing midstance phase of gait; while the foot itself, having a minimum of pronation or supination, functions at its optimum since the footwear itself has been adapted to the flat surface.

The footwear of the present invention has a more even and harmonious contact with a flat surface and the push-off phase of the gait is more firmly focused on the first metatarsal-phalangeal joint (big toe joint) with the weight-bearing gravitational forces being more evenly directed through the foot for most optimum, efficient, and effective standing, walking, or running.

In addition to those individuals with a valgus (everted) forefoot type (approximately 5 percent of the entire population) who would benefit from the advantages of the present invention; firmly focusing the propulsive forces on the first ray segment of the foot becomes a distinct and added advantage to those individuals who also possess the anatomical variation of hypoplasia (shortness) of the first metatarsal bone since a short first metatarsal bone itself encourages additional pronation in the propulsive phase of gait and thereby offsets excessive amounts of supination of the foot.

It has been found that, on the average, 4 degrees to 8 degrees of angulated compensation of the forefoot from the medial aspect of the footwear to the lateral aspect of the footwear seams to be preferred. The area of compensation angulates and slopes upward and toward the lateral aspect of the footwear in all directions from its vertex at the area beneath the medial aspect of the navicular bone. It then radiates from proximally to distally from this vertex and at the same prescribed angle to encompass the following areas of the forefoot: (1) the area beneath the internal (medial) cuneiform and base of the first metatarsal bones; (2) the area diagonal to the longitudinal and transverse arches of the foot and shafts of the metatarsal bones; (3) the areas beneath the five metatarsal-phalangeal joints (the ball of the foot); (4) the area beneath all of the toes.

Compensating between 8 degrees plus or minus amounts up to 6 degrees provides good results at the lateral aspect of the footwear. This provides an angular range and sets parameters of not less than 2 degrees nor more than 14 degrees of forefoot valgus compensation. For example, a sole of a shoe of a particular size, width, and style may slope from a thickness of $\frac{3}{8}$ of an inch greater on the lateral aspect at the forefoot of the footwear to the medial aspect at the forefoot of the footwear providing an 8 degree angle; while in yet another shoe of a different size and width, the sole of this same style shoe, may slope from this same thickness of $\frac{3}{8}$ of an inch greater on the lateral aspect than on the medial aspect at the forefoot of the footwear providing yet a different angle. This is also true in examples where the angle of the forefoot compensation remains constant while the thickness achieved at the lateral aspect varies; again depending on the size, width, and style of the particular footwear. In each and every example, however, the relative thickness of the forefoot compensation at the lateral aspect of the footwear is always thicker than that at the medial aspect of the forefoot of the footwear by the prescribed amount.

In effect, for such shoes, ⅜ of an inch, plus or minus, amounts up to 5/16 of an inch usually provides angular equivalents of 8 degrees plus or minus amounts up to 6 degrees. An angular range of from 2 degrees to 14 degrees of forefoot valgus wedge compensation or a dimensional range of from 1/16 of an inch to 11/16 of an inch (approximately 0.16 centimeters to approximately 1.74 centimeters) of thickness, greater on the lateral aspect than on the medial aspect of the forefoot; would, under most circumstances, achieve the desired results.

These parameters are necessary and adviseable in order to be able to gradually introduce the novel and revolutionary concept of the present invention into use among the general population; since it is often necessary to gradually increase the amount of forefoot valgus wedge angulation in moderate increments, slowly, and over a gradual period of time in order to effectively achieve greater compliance and acceptance of the concept with fewer side effects, less discomfort, and shorter periods of adjustment.

It may also be necessary and adviseable for certain individuals to be afforded the opportunity to obtain different, varying, and/or graded amounts of forefoot valgus compensation in a manner similar to the present day shoe size and width selections or in the form of prescription footgear when their particular needs fall outside of the usual and customary 4 degrees to 8 degrees average range of everted forefoot valgus angulation. In this regard, it may also be necessary for shoe salespersons to be additionally trained in the proper evaluation of the various foot types so that they might become more sophisticated in their ability to distinguish true forefoot valgus from forefoot varus foot types in order to select the appropriate forefoot compensation for the individual's particular foot type and planal predominance.

The sole of the footwear of the present invention is also beveled from the heel down toward the toes on the medial aspect. This longitudinal bevel created by the taper of the wedge of the forefoot compensation of the present invention is similar to the effect of the conventional heel lift. Thus whether in walking or running as the footwear makes contact with the ground starting at the heel, the footwear moves forward with generally flat, smooth, and congruous impact with a flat surface. This longitudinal bevel effectively creates even greater heel lift and elevation of the rearfoot in addition to that of the conventional heel lift. This further reduces the weight on the heel and decreases heel, foot, leg, and back discomfort when one is standing still. This feature additionally tends to enhance the conventional heel lift by propelling the body forward during the act of locomotion, thus adding to the increased efficiency of walking or running, and producing faster walking or running elapsed times so important to the competitive athlete. This feature is also more consistent and compatible with the evolutionary trend toward increased equinus of the human foot; a theory proposed by careful observers in the fields of organic evolution and physical and cultural anthropology.

Although such novel feature or features believed to be characteristic of the invention are pointed out in the claims, the invention and the manner in which it may be carried out may be further understood by reference to the description following and the accompanying drawings.

Figure 9:
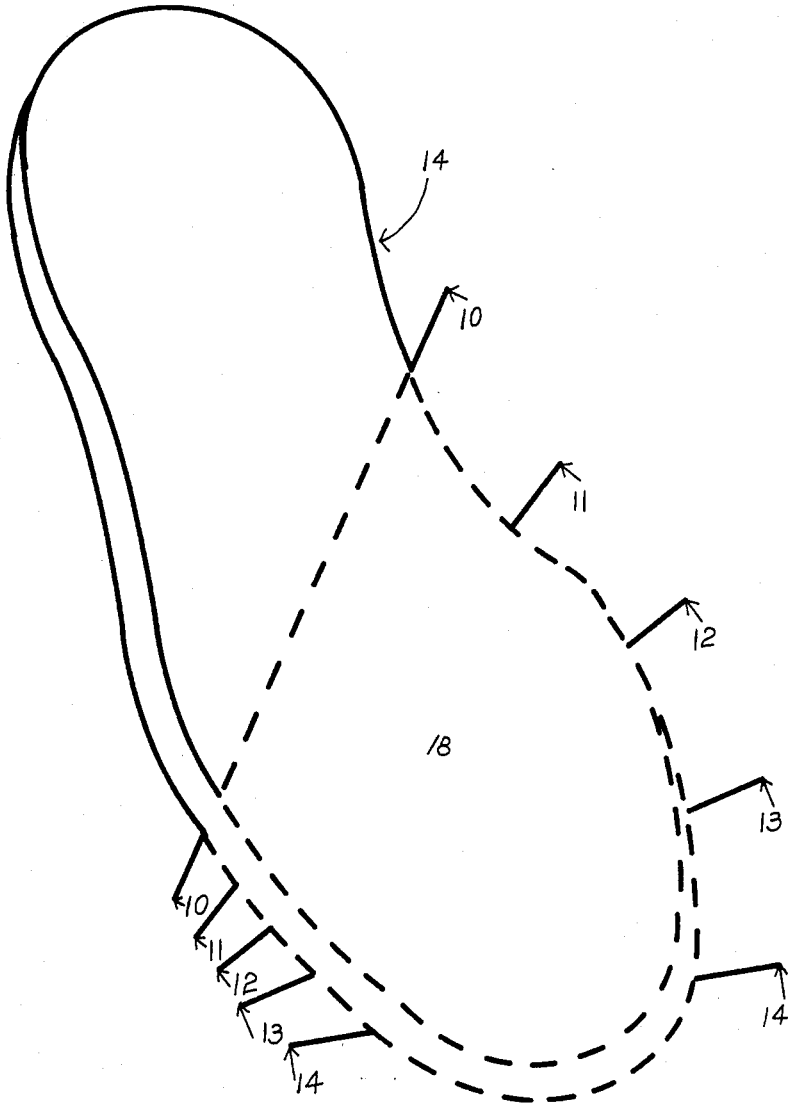
FIG. 9 is a perspective plan view of a right midsole of the present invention showing the area of the forefoot compensating wedge of the midsole in phantom and defined by the dotted areas.
Figure 10:
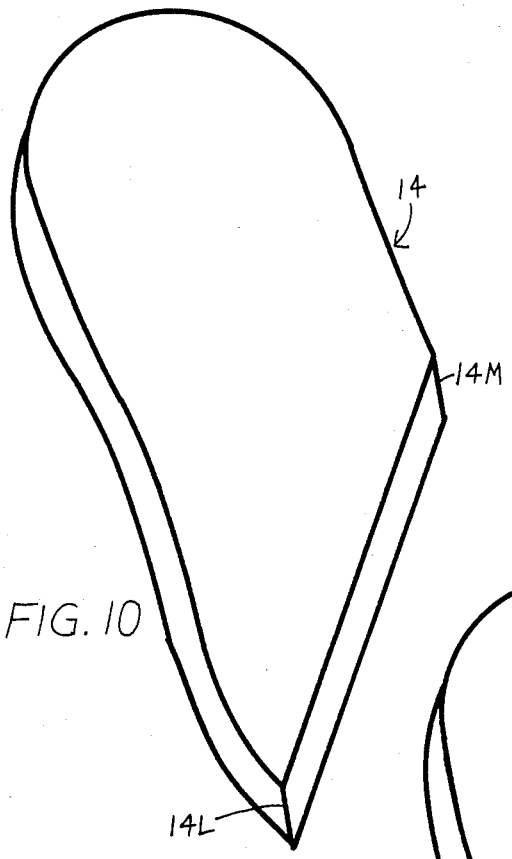
Figure 11:
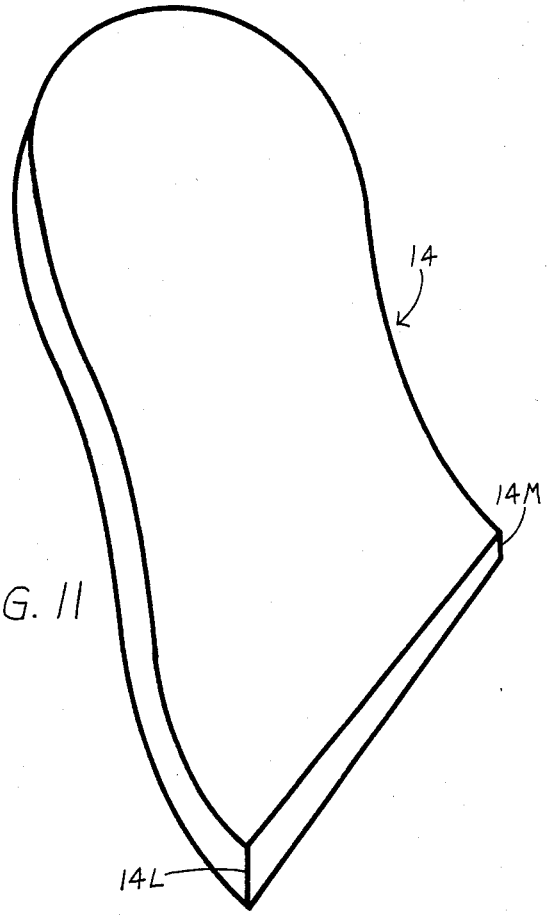
Figure 12:
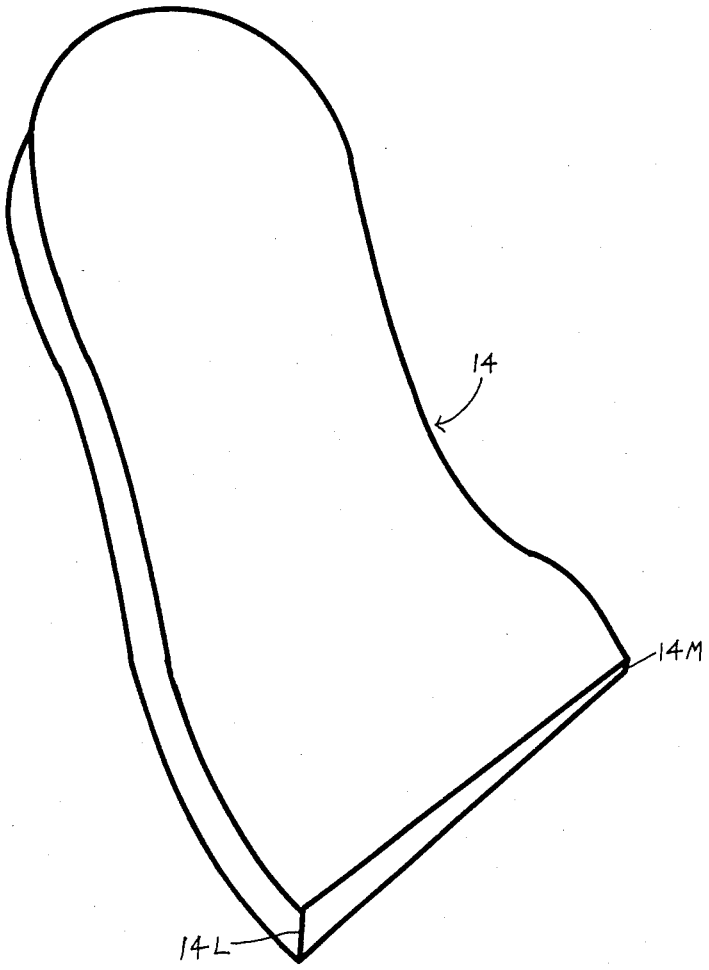
Figure 13:
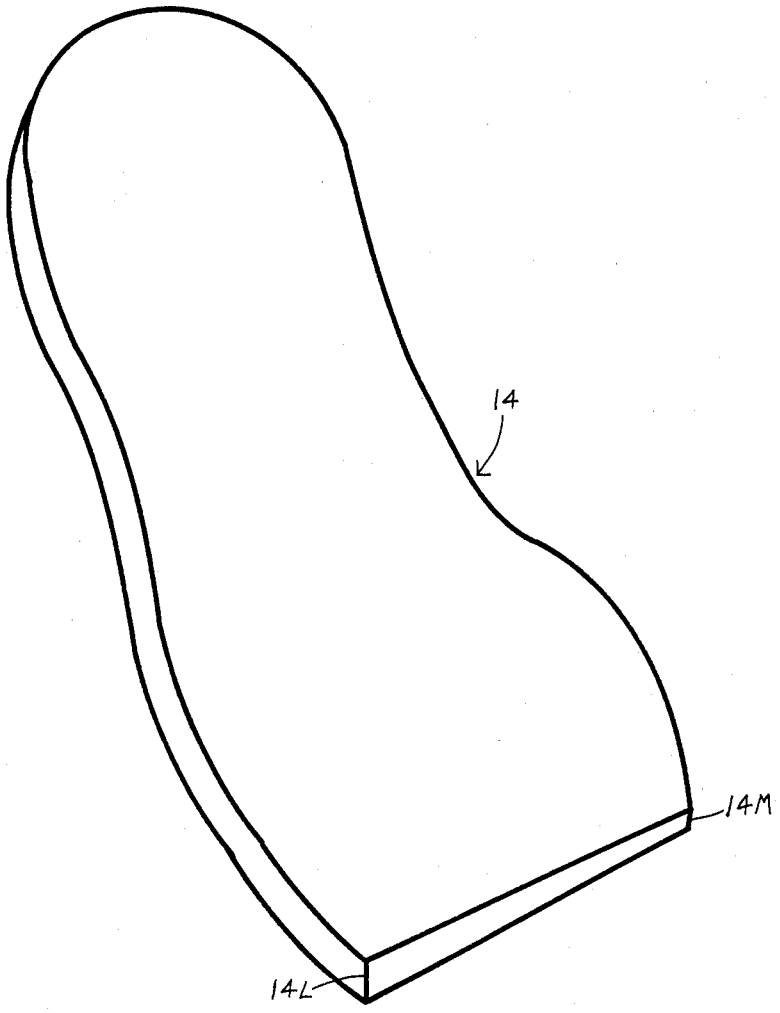
Figure 14:
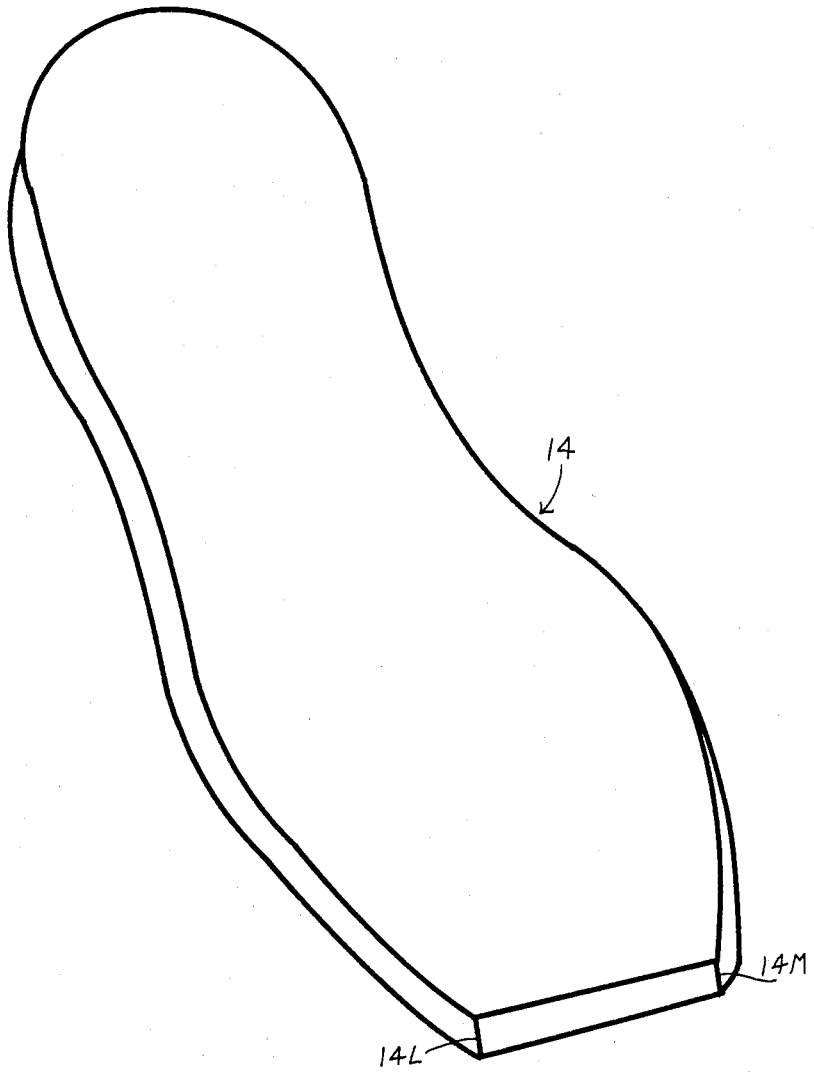

FIGS. 10 through 14 are perspective plan views along lines 10—10 through 14—14 of FIG. 9.

Referring now to the figures in greater detail, where like reference numbers denote like parts in the various figures.

As shown in the figures, an article of footwear 10, has a conventional upper 11 and a sole 12. The sole 12, exemplified in these particular drawings as a running shoe, includes an outer sole 13 and a midsole portion 14. The midsole 14 as shown in the drawings is labeled 14L and 14M to correspond with the lateral aspect and medial aspect of the midsole, respectively. When referred to as the midsole 14, the midsole is to be considered in its entirety. The midsole portion of a running shoe also usually incorporates a heel elevation wedge 17 similar to a conventional heel lift. The outer sole may include gripping surfaces 15.

Some articles of footwear may also have an innersole. Innersoles, midsoles, and/or outersoles may each become an integral part of the present invention depending on the particular type of footwear construction. In a running shoe, as exemplified in these particular drawings, the compensation of the present invention is incorporated directly into the midsole 14 with the innersole and outersole being only secondarily affected by the compensation of the midsole itself.

Figure 1:
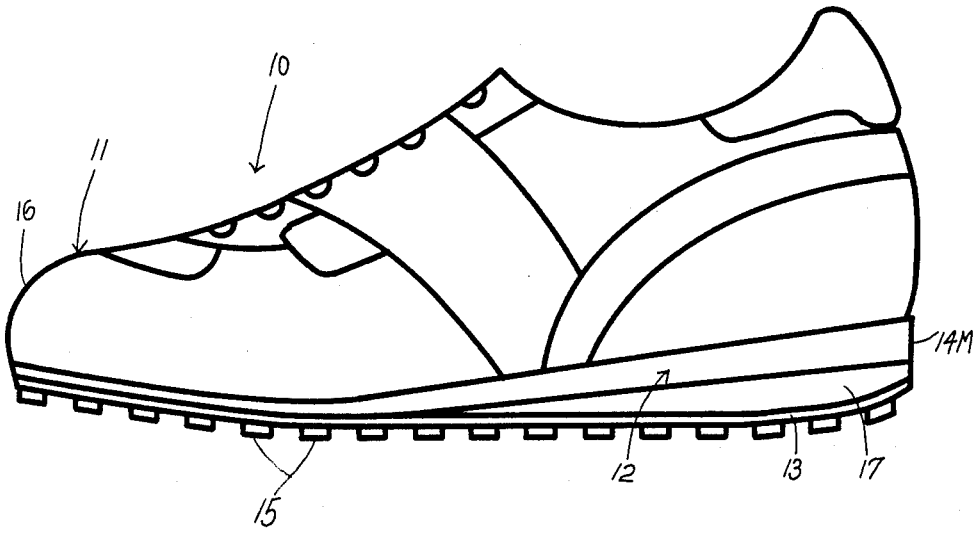
FIG. 1 is a left-side (medial) elevation of a right foot article of footwear of the present invention.
Figure 2:
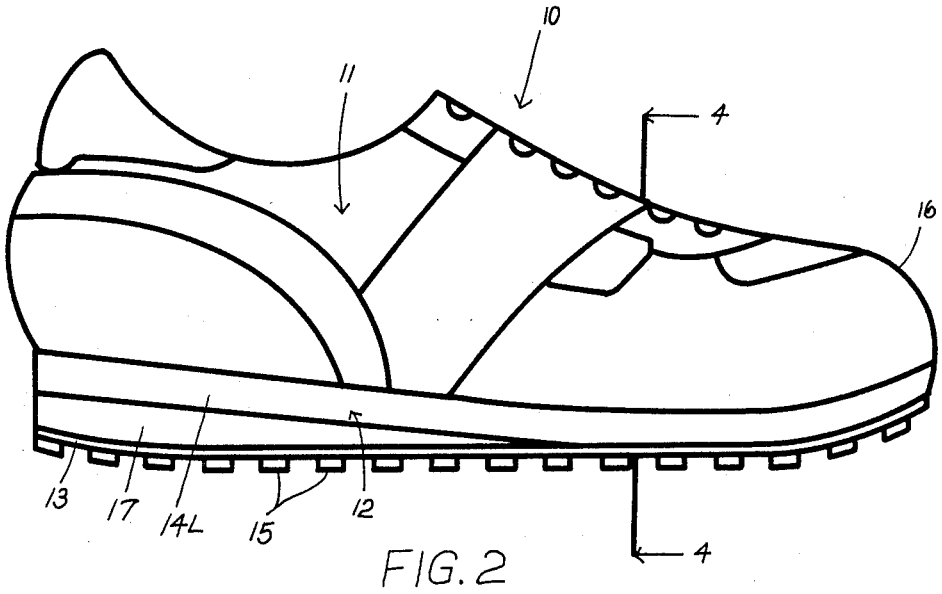
FIG. 2 is a right-side (lateral) elevation of the article of footwear of FIG. 1.

The heel elevation 17, as shown, tapers on both the medial and lateral aspects of the footwear from the heel towards the toe 16, as can be seen in both FIG. 1 and FIG. 2. This longitudinal taper brought about by the use of a conventional prior art heel elevation is not integral to the present invention. The present invention functions equally well in the environment of a flat sole or higher heel shoe and is essentially not affected by the relative height of the heel or sole of the shoe.

The midsole 14, as shown, tapers on the medial aspect (14M) from the heel towards the toe 16 as can be seen in FIG. 1. This longitudinal taper of the midsole 14M, only on the medial aspect, is created by the forefoot valgus compensating wedge of the present invention and it is in addition to the taper of the conventional heel elevation 17. This added longitudinal taper created on the medial aspect is integral to the present invention and desirable for increased efficiency of walking or running. It will be noted that the midsole 14 retains a constant thickness in the area of the rearfoot and across the width thereof as can best be seen in FIG. 10.

Figure 3:
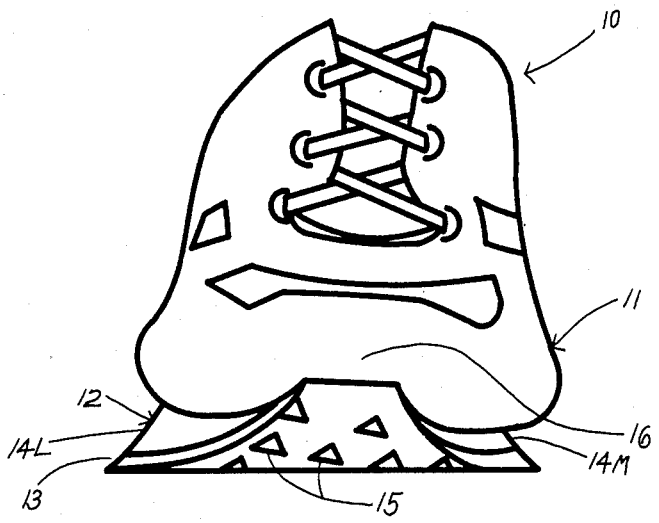
FIG. 3 is a front elevation of the article of footwear FIG. 1.
Figure 4:
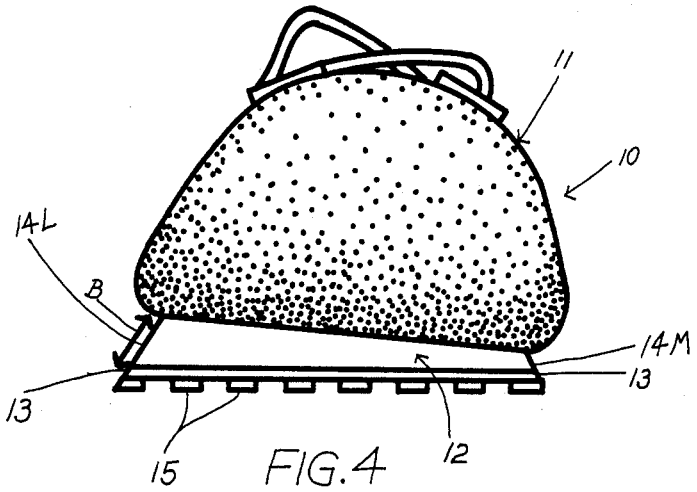
FIG. 4 is a section of FIG. 2 along lines 4—4.

The thickness of the sole slopes upward from the medial aspect of the forefoot of the footwear, to a height of ⅜ of an inch plus or minus amounts up to 5/16 of an inch greater at the lateral aspect in the area beneath the fifth metatarsal-phalangeal joint of the foot than at the medial aspect, as can be seen at line B in FIG. 4. FIG. 4 is a section of FIG. 2 along lines 4—4. This graded thickness of the forefoot valgus compensating wedge can also be observed by comparing the forefoot midsole sections 14L and 14M as illustrated in FIGS. 1, 2, and 3, each one to the other.

In other articles of footwear, in which types of construction there is no midsole, the forefoot valgus compensation of the present invention would be incorporated directly into either the innersole or the outersole of the footwear itself.

Figure 6:
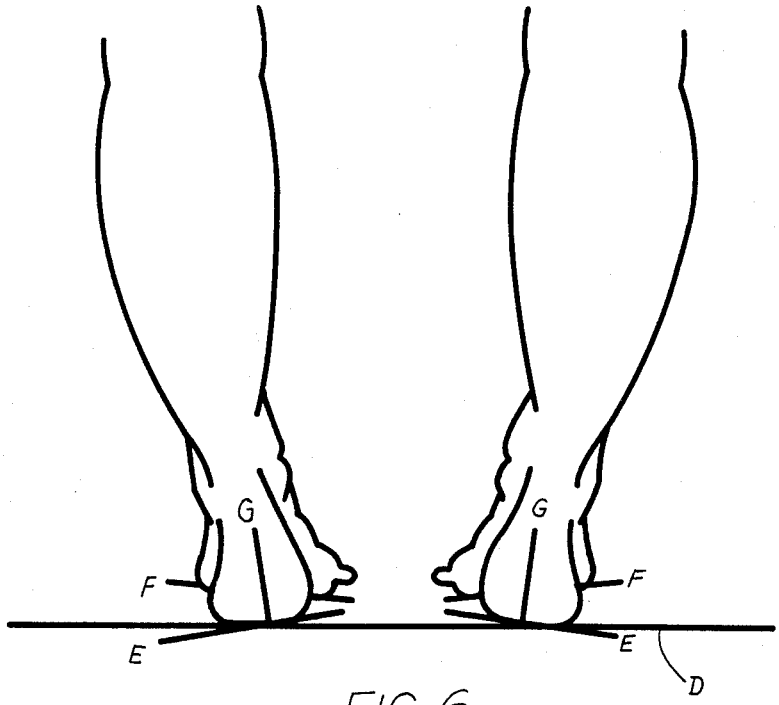
FIG. 6 is a rear view of dangling, off weight-bearing, feet showing the normal and average inversion of the rearfoot relative to a flat surface and the normal and average eversion of the forefoot relative to the rearfoot in an individual who has a forefoot valgus foot type.
Figure 7:
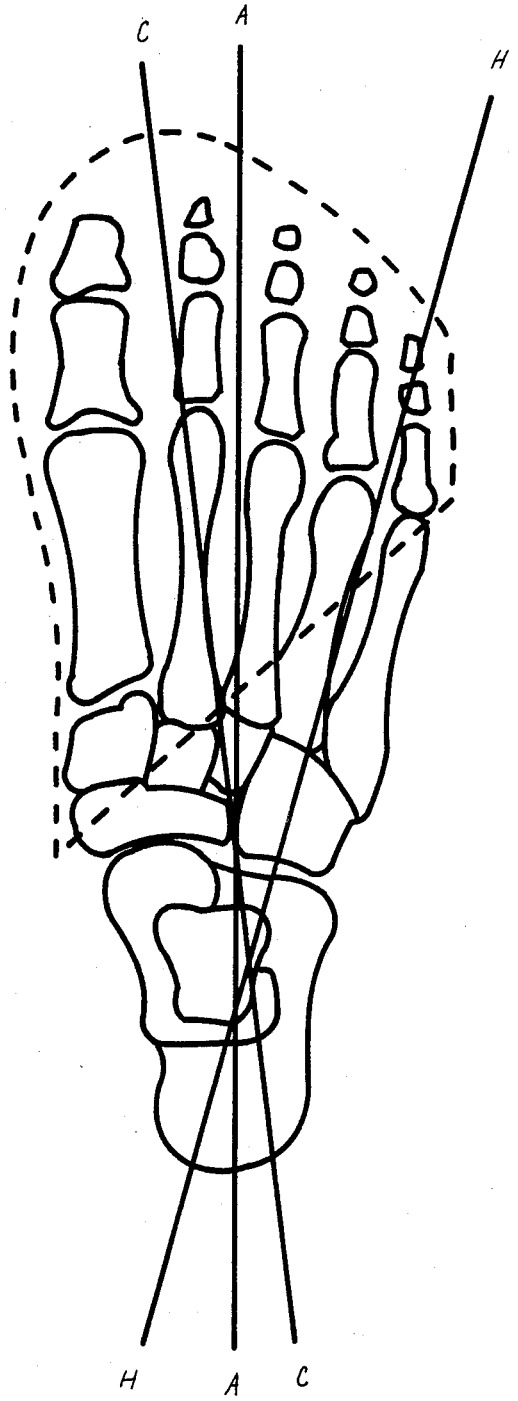
FIG. 7 is a plan view of a skeletal right foot showing the area of the forefoot compensation of the footwear of the present invention as defined by the dotted area, along with lines denoting the median sagittal plane (A), the normal longitudinal axis of motion (C), and the laterally displaced longitudinal axis of abnormal and excessive supination (H), drawn through the foot.

The area of the forefoot to be compensated in the shoe is shown in FIGS. 7 and 9, as defined by the dotted areas. FIG. 7 shows the area of forefoot valgus compensation in its relationship to the midtarsal and metatarsal bones, joints, and toes of a right foot. FIG. 9 shows the area of forefoot valgus compensation of a right shoe midsole. The upsloping of the sole at the lateral aspect of the forefoot to a height of ⅜ of an inch, plus or minus amounts up to 5/16 of an inch, generally provides an angulation of 8 degrees plus or minus amounts up to 6 degrees beneath the ball and toes of the foot. The midsole 14, at the area of the metatarsal-phalangeal joints of a foot, lines 4—4 in FIG. 2, slopes at an angle preferrably of about 8 degrees, plus or minus amounts up to 6 degrees, so that the forefoot, in the footwear 10, has the metatarsal bones, metatarsal-phalangeal joints, and toes of the foot aligned at the everted angle of the valgus forefoot, substantially as shown in FIG. 6, which shows the natural position of the feet of the occasional individual with a forefoot valgus foot type.

Figure 5:
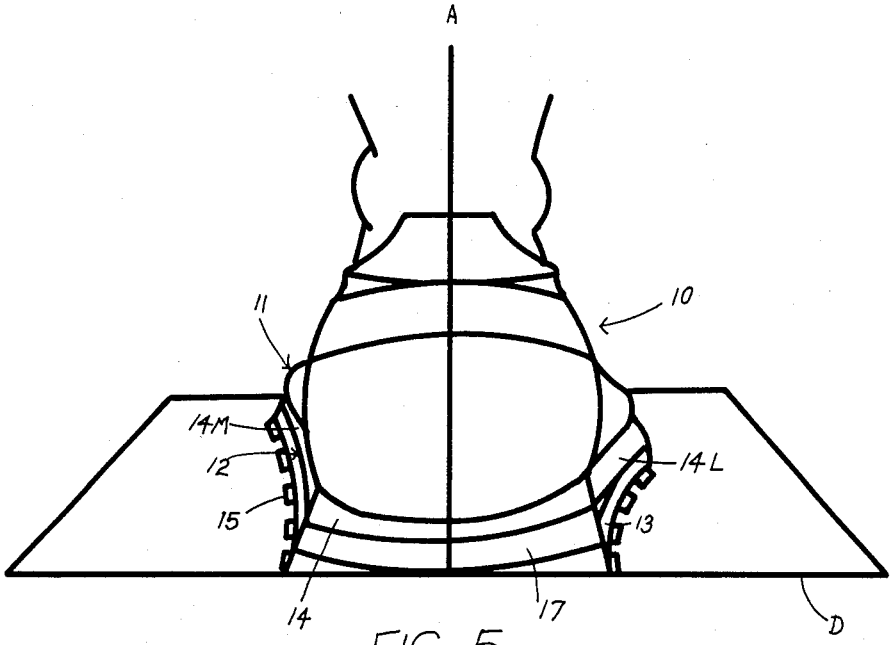
FIG. 5 is a rear view of a right foot article of footwear of the present invention fully weight-bearing in the midstance phase of gait.

In FIG. 6, line D represents a horizontal plane. Lines E and G show the normal and average inversion of the rearfoot relative to the horizontal plane D. This inversion is oftentimes referred to as rearfoot or subtalar joint varus. Line F represents the occasional and average forefoot eversion. It is in a direction and plane that is opposite to the inversion of the rearfoot (lines E and G) and is generally referred to as forefoot or midtarsal joint valgus. The position of the feet in FIG. 6 represents the natural position of the feet with their normal and average amounts of inherent rearfoot inversion and forefoot eversion in the occasional forefoot valgus foot type. That is, the non-weight-bearing or dangling position of the feet in their natural relationship to a flat surface. The natural position of the foot, particularly the forefoot, is essentially unchanged within the shoe when weight-bearing and wearing the footwear 10 of the present invention, such as shown in FIG. 3. FIG. 5 also shows the foot in its natural position when fully weight-bearing; however, it should be noted that the normal amount of rearfoot motion, in the form of normal pronation has been allowed to occur in the foot's position in FIG. 5. This change in rearfoot position, motion, and function in the form of normal pronation can be noted by comparing the naturally inverted position of the rearfoot depicted by line G in FIG. 6, to its perpendicular (square and level) position denoted by line A in FIG. 5. While this normal amount of pronation has been allowed to occur when wearing the footwear 10 of the present invention it will be noted that the foot is without any excessive pronation or supination. Prior are rearfoot compensations, particularly Subotnick in his U.S. Pat. No. 4,180,924 and Block in his U.S. Pat. No. 4,262,435 restricted this normal rearfoot function in their attempt to control or eliminate excessive rearfoot pronation. Abnormal and excessive supination of prior art footwear, whether rearfoot compensated or not, is shown by comparing the laterally displaced line H in FIG. 8, representing an excessive amount of supination in prior art footwear, to line A in FIG. 5, showing no abnormal or excessive supination of the footwear 10 of the present invention.

Line A in FIG. 5 is the median sagittal plane and bisection of the heel as viewed from the rear and is the same line as line G in FIG. 6; having allowed, however, for the heel (rearfoot) to move its anticipated and normal amount from its naturally inverted off weight-bearing position, line G in FIG. 6, to its fully weight-bearing midstance position, line A in FIG. 5. Line A in FIG. 5 is also the same line and in the same plane as Line A, the median sagittal plane of the foot, as shown in FIG. 7, viewed from the top rather than from the rear.

Figure 8:
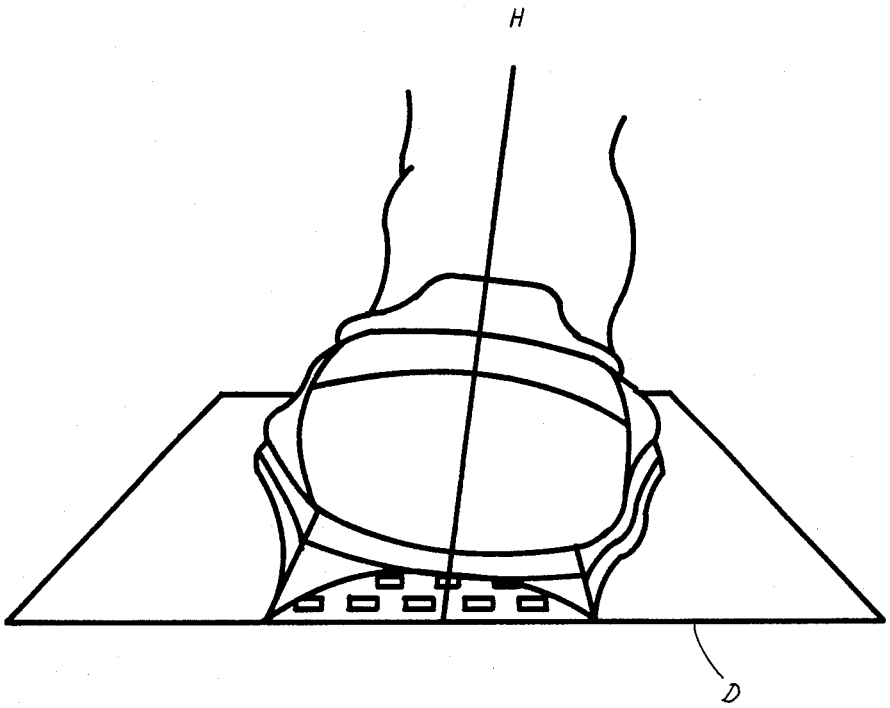
FIG. 8 is a rear view of a right foot article of prior art footwear abnormally and excessively supinated when fully weight-bearing in the midstance phase of gait.

Line H in FIG. 8 is a rear view of the laterally displaced longitudinal axis of abnormal and excessive supination of prior art footwear and is also the same line shown in the same plane as line H in FIG. 7, as viewed from the top rather than from the rear.

It will be noted that the longitudinal axis of abnormal and excessive supination, line H in FIG. 7, is laterally displaced from both the normal longitudinal axis of motion, line C in FIG. 7, and the median sagittal plane of the foot, line A in FIG. 7. The more these lines are divergent; the greater the amount of abnormal and excessive supination is present in the foot. The more closely that these lines are aligned; the more closely one achieves the ideal biophysical criteria for normal position, motion, and function of the foot.

Lines D as shown in FIGS. 5, 6, and 8 represent a horizontal, flat surface and are the same lines in the same plane and remain constant.

FIG. 9 shows a right shoe midsole 14 in perspective view and in phantom with a forefoot compensating valgus wedge 18. The sections of the midsole 14 as shown in FIG. 10 through 14 show the preferred embodiment of the forefoot valgus compensating wedge which generally increases in thickness from the medial aspect to the lateral aspect as shown in sections 11 through 14. The area of the forefoot valgus compensation from proximal to distal encompasses the area beneath the medial aspect of the navicular bone, the internal (medial) cuneiform and base of the first metatarsal bones, the area diagonal to the longitudinal and transverse arches of the foot and shafts of the metatarsal bones, the areas beneath the five metatarsal-phalangeal joints (the ball of the foot), and the area beneath all of the toes and extending to the tips of the toes. This area corresponds to the dotted area as shown in FIG. 7 and FIG. 9.

It has been found that a sole 12 thickness of ⅜ of an inch plus or minus amounts up to 5/16 of an inch greater at the lateral aspect of the forefoot than at the medial aspect of the forefoot is adequate to slope the sole at the 8 degree plus or minus amounts up to 6 degrees preferred angle towards the first metatarsal bone and great toe, depending, of course, on the footwear's size and width. As the footwear's size and width gets larger, the thickness of the forefoot valgus compensation at the lateral aspect of the footwear naturally increases, even within the same style of footwear, while the angle of the forefoot compensation remains the same.

With the sole 12 thus sloped and the metatarsal bones, joints, and toes angulated at an angle of 8 degrees plus or minus amounts up to 6 degrees; the footwear and foot, in standing or a walking or running gait, contacts a flat surface, as shown in FIGS. 3 and 5, with the body weight and gravitational forces directed through the foot moving forward in the footwear 10 onto and through weight-bearing positions with the bearing of the weight and forces passing close to the median sagittal plane as shown by lines A in FIGS. 5 and 7 and close to the normal longitudinal axis of motion of the foot (line C of FIG. 7) from rearfoot to forefoot with no heel counter distortion or excessive supination (lines H in FIGS. 7 and 8).

The valgus compensation of the forefoot naturally maintains the position and alignment of the rearfoot, placing the substantially flat outer surface of the outersole 13 against a substantially flat surface, a horizontal plane, while the structure of the foot is held in alignment close to the median sagittal plane, lines A in FIGS. 5 and 7, and with motion and function being directed close to the longitudinal axis of motion, line C in FIG. 7, not withstanding the everted position of the forefoot as shown in FIG. 6.

The footwear 10 of the present invention thus substantially eliminates excessive supination of the foot in the footwear and creates a more effective and efficient contact, gripping, and propulsive surface at a right angle and square and level, to the weight-bearing plane, lines A and D in FIG. 5.

As the foot pushes off, using the first metatarsal-phalangeal joint and the ball of the foot as a fulcrum and lever for the step, substantially full propulsion of the step is made without excessive supination as is noted by comparing the relationship of lines A and D in FIG. 5, to the relationship of lines H and D in FIG. 8.

The footwear 10 of the present invention serves to allow the foot to function as a loose adaptive shock absorber by allowing normal amounts of foot motion, in the form of normal pronation, to occur. It also serves to allow the forefoot to function as an effective rigid propulsive lever at a specific instance during the gait cycle while not allowing excessive amounts of supination to occur. This is particularly so when the forefoot valgus foot type is required to meet hard, flat, and unyielding surfaces.

The terms and expressions which are employed herein are used as terms of description only and it is recognized that various modifications are possible within the scope of the invention claimed.

It is understood the following claims are intended to cover all of the generic and specific features of the invention herein described, and all statements of the scope of the invention which, as a matter of language, might fall therebetween.

Without further elaboration, the foregoing will so fully illustrate my invention that others may, by applying current or future knowledge, readily adapt the same for use under various conditions of service.

I claim:

1. In an article of footwear having a forefoot valgus compensation, for use with a foot, said article having an upper portion and a sole, said sole having a forefoot and a rearfoot portion, said sole forefoot portion having a medial aspect and a lateral aspect, said sole forefoot portion being of varying thickness across the width thereof such that said sole slopes at an angle upwardly from said medial aspect to said lateral aspect to provide an inclined surface of greater thickness at said lateral aspect than at said medial aspect to compensate said forefoot in its valgus oriented angulation and to maintain normal alignment, position, motion and function of the entire foot during use of said article of footwear, and wherein said inclined surface compensates the forefoot beneath the medial aspect of the navicular bone, the internal (medial) cuneiform bone, the first metatarsal bone and the shafts of the lesser metatarsal bones diagonally, the metatarsal-phalangeal joints (the ball of the foot), and the toes giving the area beneath the fifth metatarsal-phalangeal joint (the little toe joint) the greatest elevation, and wherein said sole rearfoot portion is of constant thickness across the width thereof, such that the rear portion of the foot is allowed to act as an effective shock absorber when coming into contact with the ground, and wherein said inclined surface has a slope at a maximum angle of 8 degrees plus or minus amounts up to 6 degrees.

2. The sole of claim 1 wherein said inclined surface has a preferred slope at a maximum angle of 4 degrees to 8 degrees.

3. The sole of claim 1 wherein said inclined surface slopes at a maximum angle of no less than 2 degrees.

4. The sole of claim 1 wherein said inclined surface slopes at a maximum angle of no more than 14 degrees.

5. The sole of claim 1 wherein the thickness of said sole forefoot portion is preferrably at a height of $\frac{1}{4}$ inch to $\frac{3}{8}$ inch greater at the lateral aspect than at the medial aspect.

6. The sole of claim 1 wherein the thickness of said sole forefoot portion is $\frac{3}{8}$ inch plus or minus amounts up to 5/16 inch greater at the lateral aspect than at the medial aspect.

7. The sole of claim 1 wherein the thickness of said sole forefoot portion is no less than 1/16 inch greater at the lateral aspect than at the medial aspect.

8. The sole of claim 1 wherein the thickness of said sole forefoot portion is no more than 11/16 inch greater at the lateral aspect than at the medial aspect.

* * * * *